US006035569A

United States Patent [19]

Nagel et al.

[11] Patent Number: 6,035,569

[45] Date of Patent: Mar. 14, 2000

[54] DEVICES FOR MOUNTING AND DISPLAY OF ELECTRONIC LABELS AND THE LIKE

[75] Inventors: Thomas O. Nagel, Blairstown, N.J.; Harold B. Bond, Wilkes-Barre, Pa.; Jan Lindström, Sundsvall, Sweden; Börje Josefsson, Timra, Sweden; Richard Moser, Stockholm, Sweden

[73] Assignee: Trion Industries, Inc., Wilkes-Barre, Pa.

[21] Appl. No.: 08/933,473

[22] Filed: Sep. 18, 1997

[30] Foreign Application Priority Data

Jan. 20, 1997 [SE] Sweden ..... 9700151

[51] Int. Cl.[7] ..... G09F 3/18; G09F 3/20

[52] U.S. Cl. ..... 40/661.03; 40/649; 40/651; 40/658

[58] Field of Search ..... 40/649, 651, 658, 40/661.03; 248/223.41, 224.51, 225.11, 231.21

[56] References Cited

U.S. PATENT DOCUMENTS

| | | | |
|---|---|---|---|
| 1,973,413 | 9/1934 | McDonnell . | |
| 3,313,054 | 4/1967 | Madey | 40/651 |
| 4,155,459 | 5/1979 | Marschak | 248/223.41 |
| 4,483,502 | 11/1984 | Fast . | |
| 4,531,311 | 7/1985 | Howard et al. | 40/649 |
| 4,698,928 | 10/1987 | Soporowski | 40/605 |
| 4,762,235 | 8/1988 | Howard et al. | 40/651 |
| 4,881,707 | 11/1989 | Garfinkle | 40/661.03 |
| 5,044,104 | 9/1991 | Hopperdietzel | 40/649 |
| 5,197,215 | 3/1993 | Torsleff | 40/649 |
| 5,473,833 | 12/1995 | Ostrovsky | 40/658 |
| 5,511,332 | 4/1996 | Sturkie et al. | 248/223.41 |
| 5,553,412 | 9/1996 | Briechle et al. | 40/642 |
| 5,799,427 | 9/1998 | Abramson et al. | 40/651 |

*Primary Examiner*—Anthony Knight
*Assistant Examiner*—Marcus Dolce
*Attorney, Agent, or Firm*—Schweitzer Cornman Gross & Bondell LLP

[57] ABSTRACT

A label holder and mounting clip for the mounting and display of electronic labels. A label holder of extruded plastic material snugly receives the enclosure of the electronic label which can be protected by a clear cover extending over the front of the label holder at least slightly spaced from the front of the label. A mounting strip is coextruded with the body of the label holder and is flexibly attached thereto by a co-extruded living hinge. Mounting brackets, of spring metal or the like, are received in pricing channels along the front of display shelving, or are otherwise mounted at the front of the shelving, and include a forwardly displaced, upwardly extending mounting tongue received in a downwardly opening slot in the flexibly attached mounting strip. The angle of display of the label may be controlled by inserting an angle bracket into the downwardly opening slot, alongside the tongue of the mounting clip, oriented so that one leg of the angle bracket extends forward and supports the back of the label holder in an upwardly angled position for a better viewing angle. Several different viewing angles are possible by omitting the angle bracket or employing it alternatively in different orientations.

5 Claims, 10 Drawing Sheets

FIG. 10
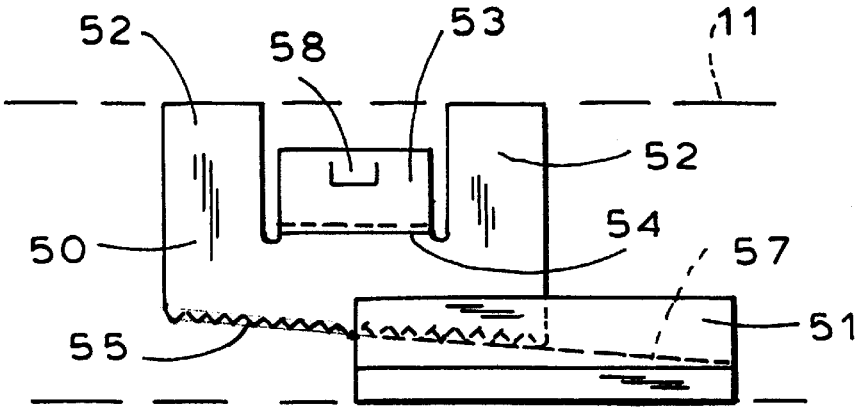
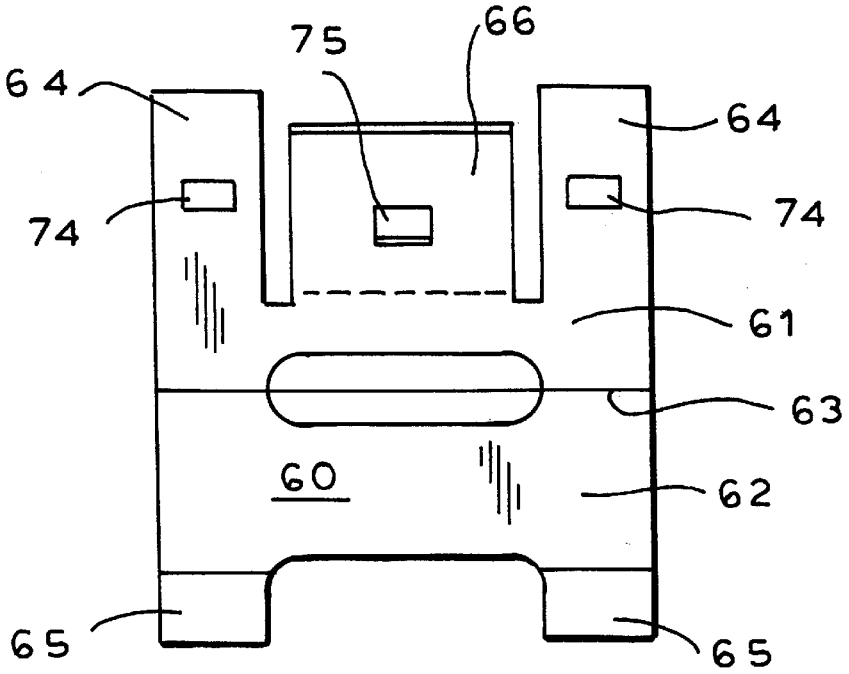
FIG. 11

FIG. 17
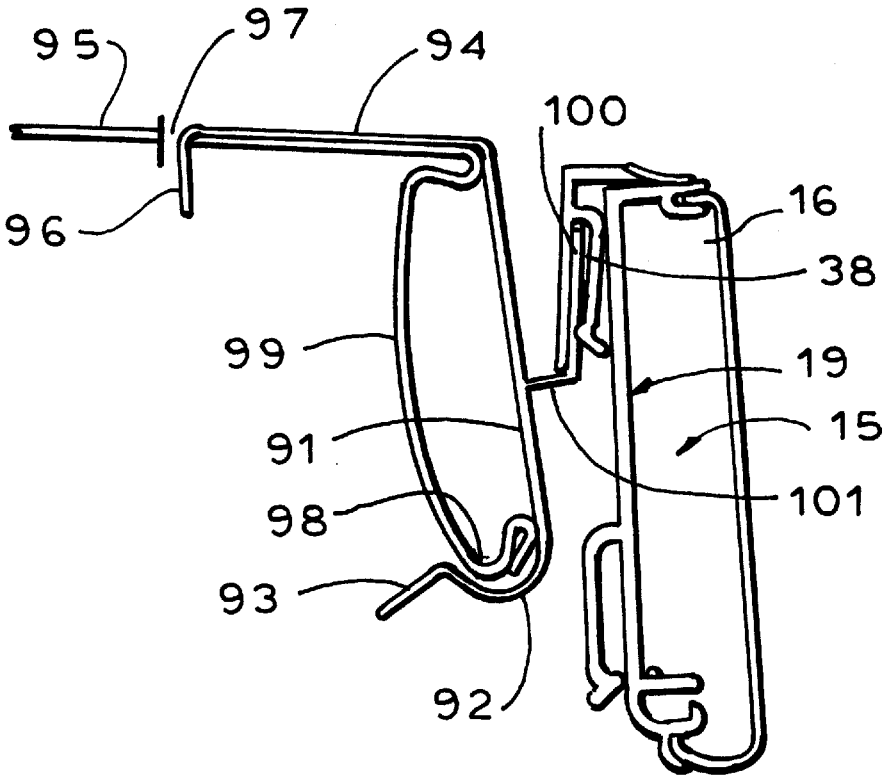
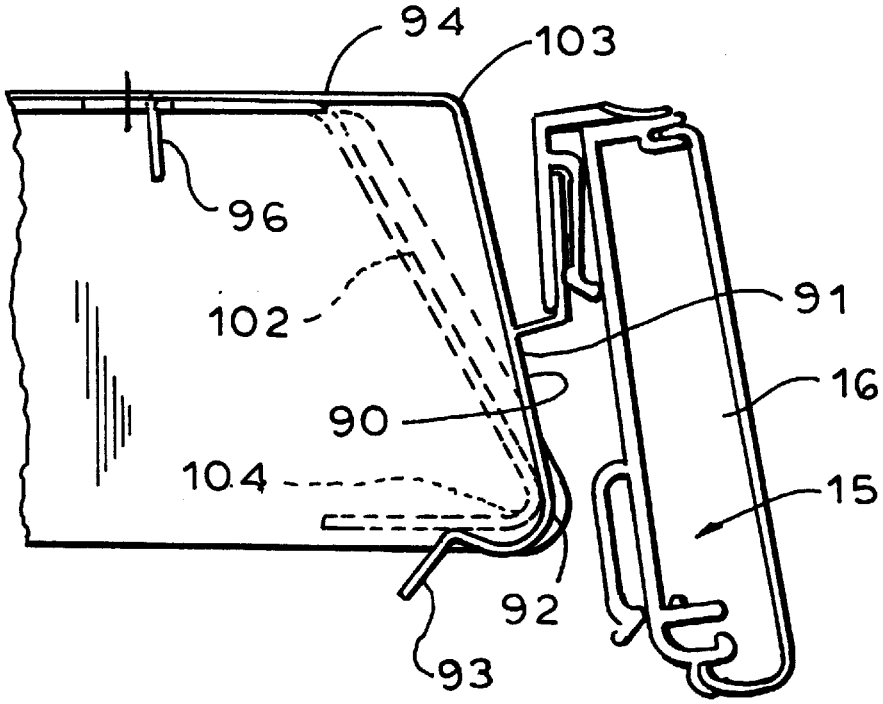
FIG. 18

DEVICES FOR MOUNTING AND DISPLAY OF ELECTRONIC LABELS AND THE LIKE

BACKGROUND AND SUMMARY OF THE INVENTION

The invention relates to the display of product and pricing information in connection with product display in supermarkets and the like.

In supermarkets, mass merchandising outlets and other retail stores, it is common practice to display merchandise on organized shelving. The shelving typically carries a pricing channel at the outer edge of each of the shelves for displaying specific pricing and product information relating to the adjacent product display. Typically, such pricing channels comprise an elongated member of generally concave configuration, having retaining flanges extending along upper and lower edges. Flexible pricing tags, of paper or plastic material and containing pricing, product information and typically bar code identification, can be easily installed in and removed from the pricing channels to maintain product pricing and information on a relatively up-to-date basis.

Currently, there is a desire on the part of many supermarkets and mass merchandisers in particular to substitute so-called "electronic labels" for conventional printed labels formed of flexible paper or plastic. The electronic labels are self-contained electronic devices (powered by batteries, solar panels or other means) including a display window with a liquid crystal display or the like for presenting the desired product and pricing information, bar coding and the like. An individual electronic label is provided for each product classification, in the same manner as conventional printed labels. A particularly desirable and advantageous feature of the electronic labels is the ability to control and change them remotely from a central computer via wireless communication. This enables rapid, remote controlled repricing of products as frequently as desired. For example, a store may easily reprice many of its products in accordance with observed traffic flow patterns during the course of a typical day, as by having special sales during a one or two hour period when traffic is customarily low, in order to encourage a greater uniformity of daily traffic patterns. Such short term repricing is essentially impossible to conduct on a large scale with conventional manual pricing techniques.

Along with the many advantages of electronic labels, come certain problems that must be solved and accommodated. As will be appreciated, an electronic label is in the nature of a calculator or small computer, and is many times larger, bulkier and heavier than a conventional label. They are thus considerably more difficult to mount along the front edges of the display shelves. Electronic labels are also quite costly and thus need to be protected against damage from contact with shopping carts, for example. Additionally, the liquid crystal or other electronic displays of the electronic labels can be difficult to read if viewed at a substantial angle to the face of the display window. Accordingly, it is important to mount the electronic label so that it tends to be relatively square to the viewing direction of the shopper. Thus, labels at or near normal eye level can be relatively vertically oriented, whereas those mounted on lower shelves optimally are disposed at an angle facing upwardly toward the viewer, with the optimal angle to the vertical being greater at progressively lower shelf levels.

In accordance with the invention, a new and improved arrangement is provided for housing and mounting of electronic labels at the front edges of product display shelving, enabling the electronic labels to be easily but ruggedly mounted, well protected and adjustably positioned. The devices of the invention enable electronic labels to be utilized in an entirely practical and effective way in conjunction with display shelving of existing design and construction, such that the installation of electronic labels does not require extensive rebuilding of the display fixtures.

One aspect of the invention is directed to the provision of a novel and improved holder for an electronic label. The label holder, preferably formed by extrusion processes, comprises a back wall and upper and lower, forwardly extending flange walls for receiving and tightly gripping the upper and lower edges of an electronic label device. The label holder incorporates a continuous mounting strip, which extends along the full length of the label holder back wall and is connected to an upper portion of the holder by means of a coextruded flexible living hinge section, enabling the mounting strip to be disposed at a variety of angles with respect to the back wall of the label holder. A transparent cover, also of extruded or co-extruded plastic material, is closed over the front of the label holder to enclose and protect an electronic label installed within the main holder section.

The attached, hingable mounting strip is provided with a continuous, downwardly opening slot which serves dual functions: It enables the mounting strip to be mounted upon an upwardly extending support element, by which the label holder and the contained electronic label can be mounted firmly in a pricing channel. The slot also provides for the reception of a removable angle bracket by which the hinge angle between the mounting strip and the back wall of the holder may be varied, in order to present the electronic label at a desired viewing angle.

The present invention is also directed to a variety of mounting clips or brackets which are readily and securely installed in pricing channels of various sizes and configurations, to accommodate easy and secure mounting of the above mentioned label holders and the electronic labels contained therein. In this respect, conventional pricing channels come in a variety of sizes and shapes, and the invention contemplates the provision of a variety of mounting clips of novel design and construction to accommodate the conventional variety of channel sizes and shapes. In one preferred form of the invention, the mounting clip is constructed in two pieces slidably related to each other. At least one and preferably both pieces are provided with an inclined surface, such that lateral adjustment of one part of the clip relative to the other changes the overall height of the clip so that it can be tightly fitted in a variety of pricing channels.

In another preferred form of the invention, a one-piece clip is designed to be installed in the pricing channel in either of two reversible orientations to accommodate a wide range of channel dimensions.

In yet other preferred embodiments of the invention, intended for use in conjunction with metal shelving provided on the top with regularly spaced through openings, novel mounting clips are provided with lugs or tabs arranged to be received in such openings and with a clamping portion arranged to grip the bottom portions of the shelving.

In any of its forms, the invention serves to accommodate in a highly practical, economical and effective way the mounting and display of electronic labels in connection with existing, conventional display shelving.

For a more complete understanding of the above and other features and advantages of the invention, reference should be made to the following detailed description of a preferred embodiment of the invention and to the accompanying drawings.

DESCRIPTION OF THE DRAWINGS

FIGS. 9 and 10 are front elevational views of the mounting clip of FIG. 8, illustrating the bracket in adjusted positions for relatively narrow and relatively wide pricing channels respectively.

FIG. 11 is a front elevational view of a one-piece reversible form of clip for mounting of a housing and electronic label in a conventional pricing channel.

FIG. 17 is a side elevational view of the clip of FIG. 16, shown mounted on one form of metal shelving, and mounting a label housing.

FIG. 18 is a side elevational view of the clip of FIG. 16, shown installed on a second style of metal shelving.

DESCRIPTION OF PREFERRED EMBODIMENTS

Figure 1:
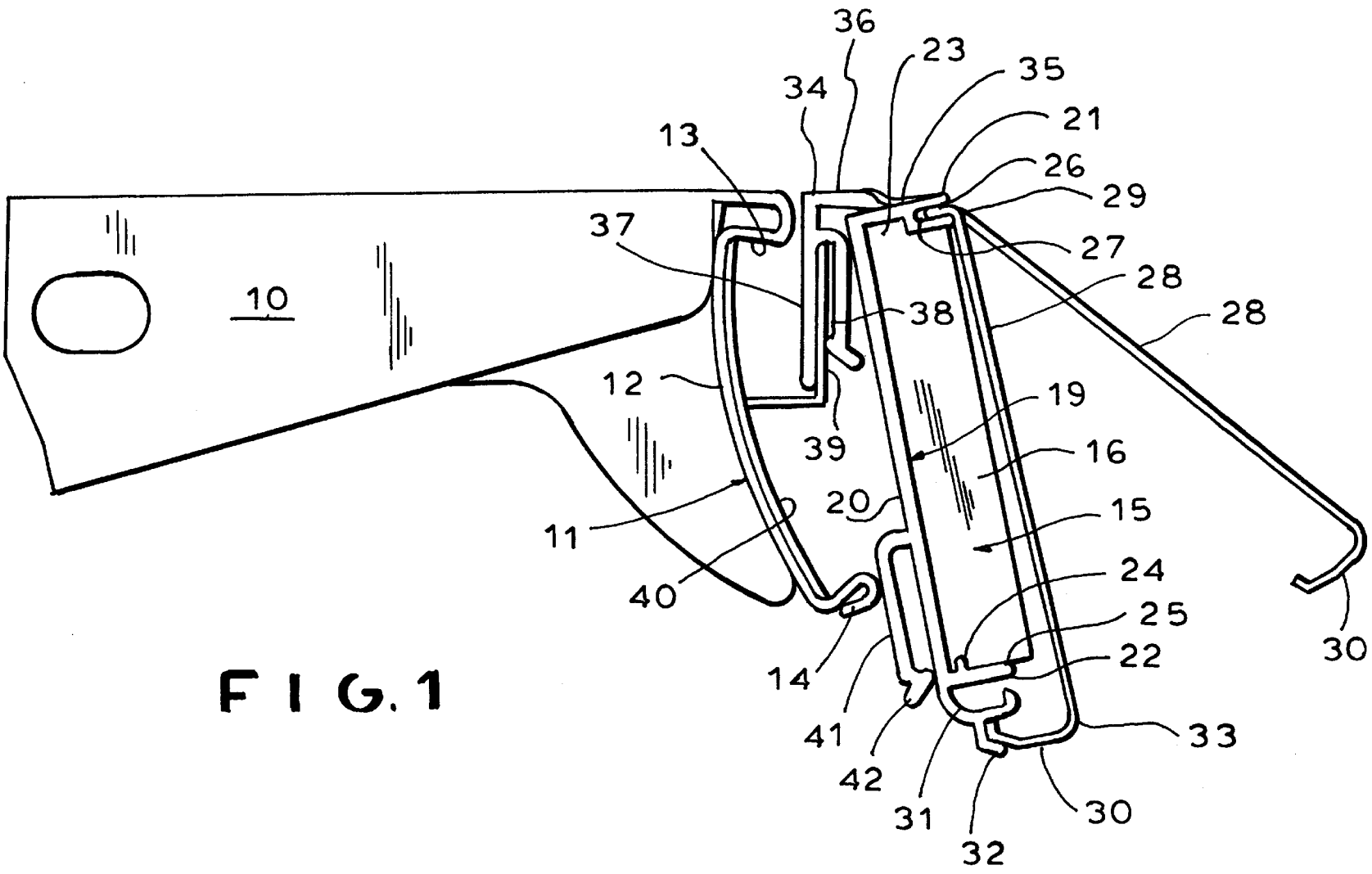
FIG. 1 is a side elevational representation of a housing according to the invention for mounting of an electronic label at the front of display shelving, with a cover shown in open and closed positions.

Referring now to the drawings and initially to FIG. 1, the reference numeral 10 designates a section of display shelving mounting a pricing channel 11 along its front edge. The pricing channel 11, which is generally representative of a wide variety of such channels, includes a central body 12 of concave contours, and upper and lower, forwardly projecting retaining flanges 13, 14. The retaining flanges typically are angled slightly inward, toward each other to define an acute angle with adjacent portions of the concave central section 12. The configuration is designed to receive and retain plastic or paper labels containing pricing and product information related to products (not shown) displayed on the shelving 10.

The devices of the present invention are intended to accommodate the mounting at the front of the display shelf 10 of electronic label devices 15, instead of the typical conventional paper or plastic labels. The electronic label devices 15, which form no part of the present invention, are self-contained, battery-operated electronic devices which include a housing or enclosure 16 (see FIG. 6) and one or more display windows 17, 18. The display windows may be liquid crystal displays, for example, programmed to display all of the relevant information for a given product, including pricing, product description, bar coding and other information. The electronic labels are remotely programmable via wireless communication to enable easy, rapid resetting of the labels for special sales, general repricing, etc.

Inasmuch as the electronic labels 15 are relatively expensive, and somewhat delicate, it is necessary to mount and display the labels in a secure, reliable and safe manner. In addition, the display windows of the label holder can be difficult to read at acute viewing angles, and it is thus necessary, or at least very desirable, to provide for the mounting of the labels at various viewing angles which are convenient to the purchaser.

Pursuant to the present invention, the electronic label 15 is mounted by means of a label holder 19, formed of a relatively rigid plastic material, such as rigid polyvinyl chloride, preferably by continuous extrusion processes to provide a uniform cross section throughout. The label holder 19 is provided with a back wall 20 and upper and lower forwardly extending retaining flange walls 21, 22. The spacing and configuration of the flange walls 21, 22 is arranged to conform as necessary to the upper and lower edge contours of the label enclosure 16 (which may vary from manufacturer to manufacturer). In the illustrated arrangement, the label enclosure 16 is formed with a rib 23 extending along the upper edge, and the upper flange wall 21 of the label holder is configured to lockingly receive that rib. The lower flange wall 22 of the support housing is provided with a small inwardly projecting rib 24 arranged to have frictional engagement with the lower edge surface 25 of the label enclosure such that, when the electronic label 15 is pressed into the label holder 19, it is tightly secured therein and can be removed only with intentional force.

In the form of the invention illustrated in FIG. 1, the upper flange wall 21 of the support housing is provided with an outwardly opening slot 26 for the snug reception of an upper edge margin 27 of a clear cover element 28. The cover element desirably is extruded of clear, relatively rigid plastic material, with a co-extruded portion 29 formed of softer plastic material to provide a hinge along the upper edge margin. The lower edge portion of the cover 28 is shaped with an inwardly extending flange 30 which frictionally engages with a closure flange 31 provided along the lower edge of the label holder. Desirably, the inwardly extending portion 30 of the cover, in the closed position, seats against an abutment rib 32.

In FIG. 1, in which the cover 28 is shown in both open and closed positions, it will be observed that, in the closed position, the lower front corner portion 33 of the cover is positioned well below and somewhat forwardly of the lower portion of the electronic label enclosure 16, and also that the front panel of the cover, when the cover is seated against the abutment rib 32, is spaced slightly in front of the label enclosure 16. This provides for a measure of protection of the electronic label against being bumped into by shopping carts or the like.

Figure 6:
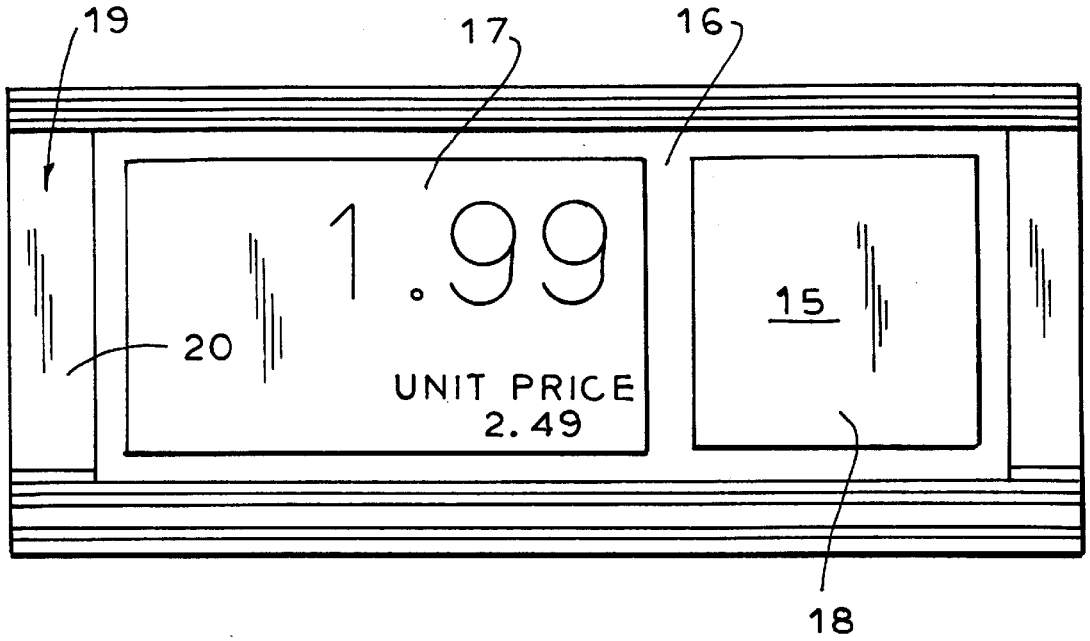
FIG. 6 is a front elevational view of the housing and electronic label of FIG. 1.
Figure 9:
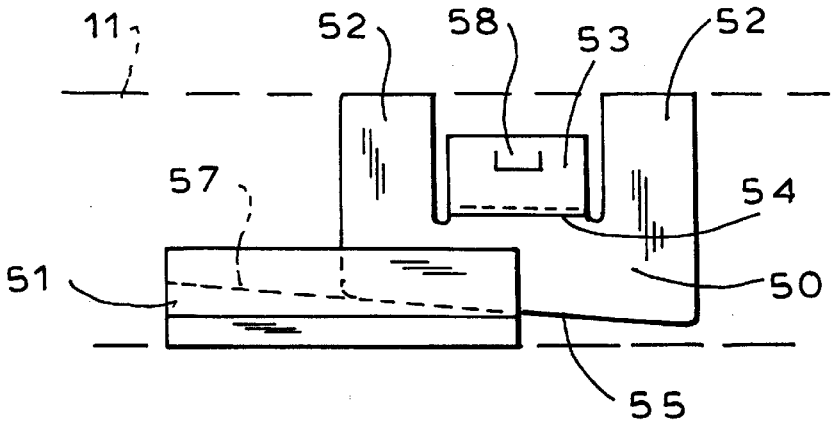

The label holder 19 may be of any suitable length, and may in fact run the full length of the shelving if desired. Since the label holder is of extruded construction, cutting it to any suitable length is a simple production operation. In many cases, however, it is advantageous to provide the support housing in lengths just slightly longer than the length of the label enclosure 16, as shown in FIG. 6.

Mounted at the back of the label holder 19 is a mounting strip 34 of extruded construction. The mounting strip 34 is permanently and flexibly secured to an upper portion of the label holder 19, preferably at the flange wall 21, by a coextruded living hinge section 35 of relatively soft plastic material, such as soft polyvinyl chloride. The rest of the mounting strip 34 is preferably extruded of a relatively rigid polyvinyl chloride material.

As shown in the drawings, the mounting strip 34 includes a rearwardly extending portion 36 and a downwardly extending portion 37 defining a downwardly opening slot 38. The slot 38 is adapted to receive an upwardly extending mounting tongue 39 of a metal mounting clip 40 to be further described. The mounting clip 40, which may be of a variety of styles as will be described hereinafter, is securely received within the pricing channel and retained therein by the opposed flanges 13, 14. The mounting tongue 39 is integral with the body of the clip and is positioned forwardly thereof. Typically and desirably, the mounting tongue 39 can be relatively narrow in width in relation to the overall length of the label support housing 19. For example, a single mounting clip 40, having a tongue 39 of less than one inch in width, may be utilized to mount a label housing 19 of six inches or so in length. Where necessary or desirable for relatively long housings, more than one clip may be employed. Since the mounting strip 34 is part of the continuous extrusion of the label housing, it extends for the full length thereof and can receive the tongue of one or more mounting clips at any one or more points along the length.

Pursuant to the invention, the co-extruded living hinge 35 joining the mounting strip 34 with the main body of the label holder 19 provides for relatively free swinging movement of the label holder relative to the mounting strip 34, which is fixed to the mounting tongue 39.

Adjacent the lower portion of the back wall 20 of the label holder is an integral clip 41 which extends downward along the lower portion of the back wall 20 and has an inwardly projecting, V-shaped flange 42 at its lower end which presses resiliently against the back wall 20. The clip 41, being part of the overall extrusion of the label holder 19, extends for the full length thereof along the bottom and advantageously can be utilized to receive temporary slips and cards, for example, for special announcements or the like. Additionally, the clip 41, shown in FIG. 1 to be supported against the lower flange 14 of the pricing strip, can provide a measure of resilient cushioning in the event the holder is bumped into.

Figure 2:
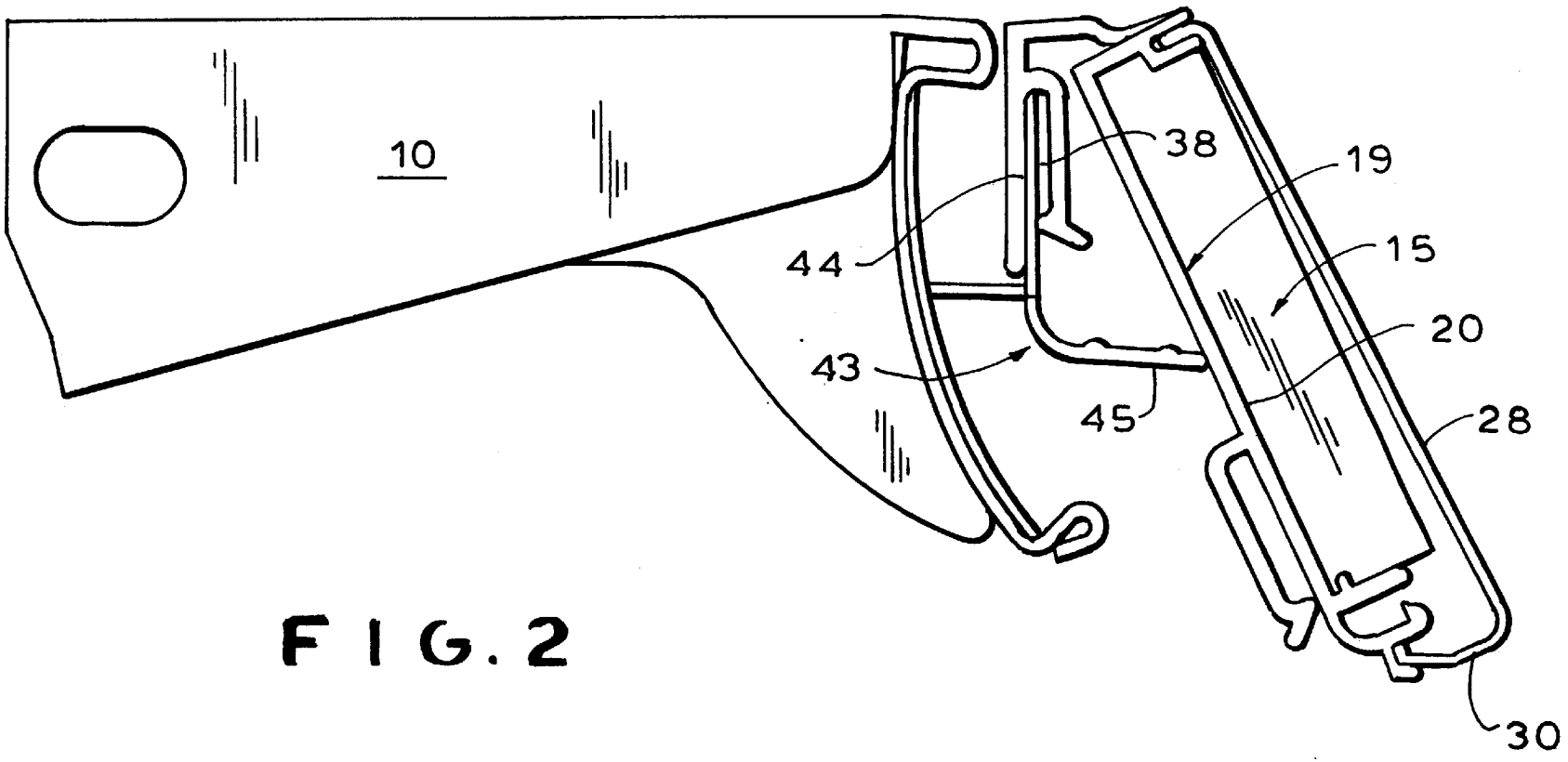
FIG. 2 is a view similar to FIG. 1, showing the housing and electronic label supported in a first viewing angle.
Figure 3:
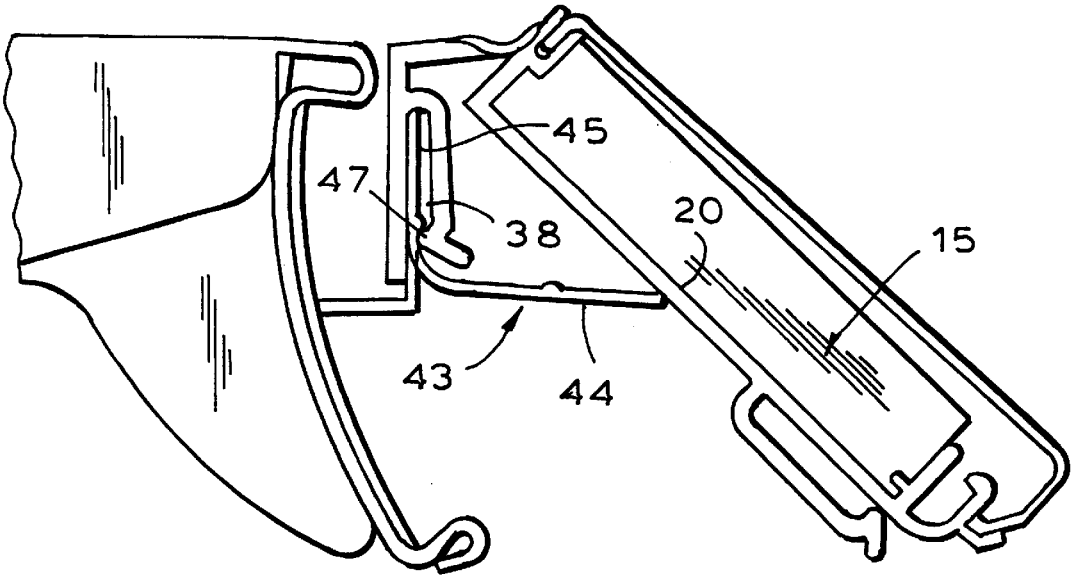
FIG. 3 is a view similar to FIG. 2, with the housing and electronic label shown disposed at a greater viewing angle.
Figure 7:
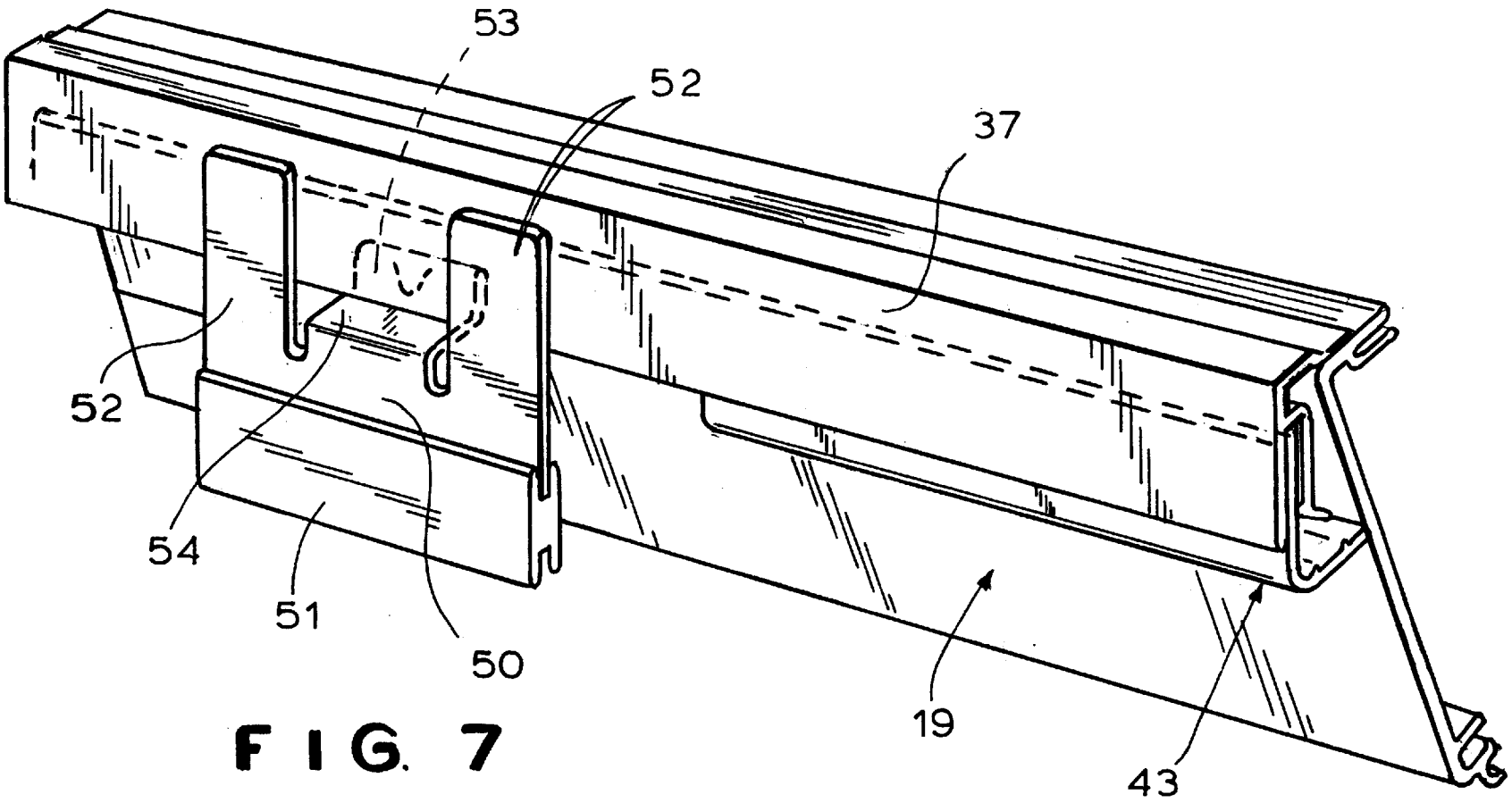
FIG. 7 is a rear perspective view of a preferred form of electronic label housing according to the invention, illustrating the housing in association with an advantageous form of mounting clip and in association with an angle bracket.
Figure 8:
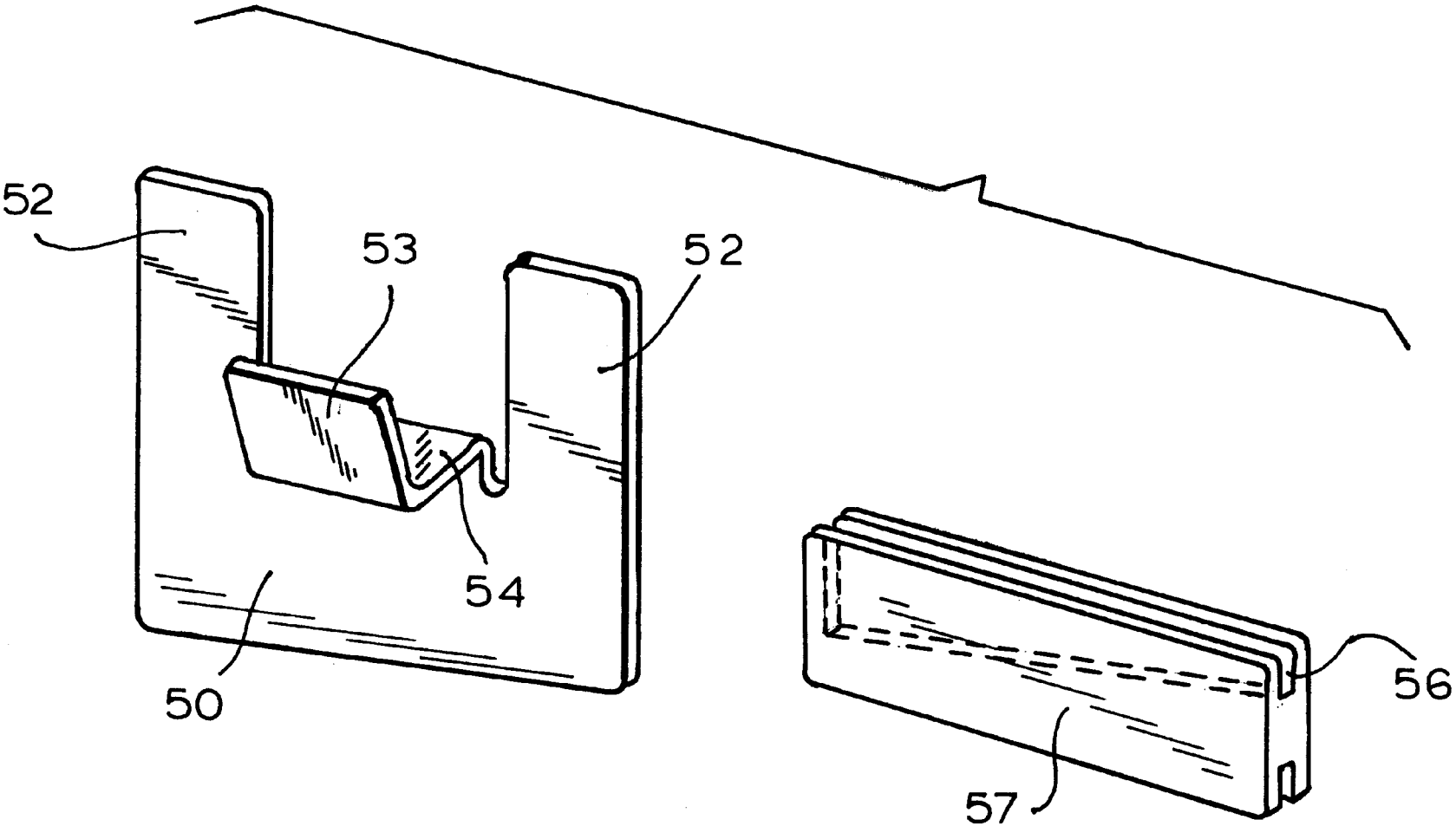
FIG. 8 is an exploded view of the mounting clip of FIG. 7.

With reference to FIGS. 2 and 3, the label holder 19 is shown supported at different viewing angles, which may be desirable for the mounting of electronic labels on the lower shelves of a display, to facilitate a more direct viewing angle for the customer. For this purpose, an angle bracket 43 (FIGS. 4 and 5) is provided. The angle bracket desirably is in the form of a continuous extrusion of uniform cross section, of generally L-shaped configuration, having a relatively longer leg 44 and a relatively shorter leg 45. The angle bracket may be cut to a suitable length, for example three inches, and one of the legs thereof inserted into the downwardly opening slot 38 of the label holder mounting strip 34, as shown in FIGS. 2 and 3. In this respect, the angle bracket is received in the slot 38 with the mounting tongue 39, but at a position laterally displaced therefrom (see FIG. 7).

When the longer leg 44 of the angle bracket is inserted in the slot 38, the shorter leg 45 extends forwardly and engages the back wall 20 of the label holder to support the label holder at a somewhat greater upward tilt than is reflected in FIG. 1, for example. To increase the angle of upward tilt, as shown in FIG. 3, the angle bracket 43 is reversed such that the shorter leg 45 thereof is inserted into the slot 38, with the longer leg 44 extending forwardly into contact with the back wall 20 of the label holder. Desirably, the respective legs 44, 45 of the angle bracket may be provided with longitudinally extending retaining ribs 46, which engage with a V-shaped flange 47 located at the lower end of the slot 38 to act as a retaining detent for the angle bracket.

As will be appreciated, when the label and label holder are extended outwardly at increased viewing angles, as reflected in FIGS. 2 and 3, there is somewhat greater vulnerability to bumping off the label holder. To this end, the angle bracket 43 is formed of a suitable plastic material, such as rigid polyvinyl chloride, which has considerable resilience for absorbing accidental bumps.

FIGS. 7–10 illustrate a particularly advantageous forms of mounting clip which can be utilized for mounting of the label holder and electronic label in the manner shown in FIGS. 1–3. The mounting clip of FIGS. 7–10 is designed to accommodate many of the wide variety of widths of pricing channels which are regularly encountered in connection with the installed base of display shelving. The form of mounting clip shown in FIGS. 7–10 comprises upper and lower sections 50, 51. Preferably, at least the upper section 50 is formed of spring sheet metal, and the lower section 51 may advantageously be formed of plastic. However, in appropriate cases, either or both parts may be made of plastic or metal materials.

In the illustrated arrangement, the sheet metal upper part 50 is shaped to provide spaced-apart, upwardly extending arms 52 arranged to extend into the upper groove of a pricing channel. Located between the upwardly extending arms 52 is an offset, upwardly extending mounting tongue 53. The tongue 53 preferably is integral with the main body of the upper clip portion 50, being offset therefrom by an integral, outwardly extending section 54. The lower edge 55 is disposed at a slight angle of incline, as shown particularly in FIGS. 9 and 10. The bottom edge 55 preferably is formed with small teeth or serrations, not specifically illustrated.

The lower portion 51 of the mounting clip, preferably formed of plastic for convenience, is provided with an upwardly opening slot 56 arranged to receive and frictionally grip the lower edge margins of the upper clip portion 50. The slot 56 is formed with an inclined bottom 57 complimentary to the inclined bottom edge 55 of the upper part 50. As is reflected in FIGS. 9 and 10, the overall height of the assembled clip 50, 51 can be varied considerably by lateral displacement of the respective parts 50, 51 with respect to each other to enable the mounting clip to be securely positioned within the upper and lower flanges 13, 14 of pricing channels 11 of different channel heights. The provision of serrations or the like (not shown) on one or both of the surfaces 55, 57 assures that the parts 50, 51, once laterally adjusted to a snug fit in a pricing channel, will remain in the adjusted relationship.

Desirably, the mounting tongue 53 is provided with a punched-out locking tab 58, the free end of which projects outward from the plane of the mounting tongue and extends in a downward direction to resist removal of the label holder, once the label holder is installed on the mounting tongue.

The mounting of the label holder on a forwardly offset tongue of the mounting clip (see representative illustrations in FIGS. 1–3) provides for a desirable degree of resilience in the mounting of the label holder to help resist damage from bumps and shocks that might be administered in the normal course of events.

Figure 12:
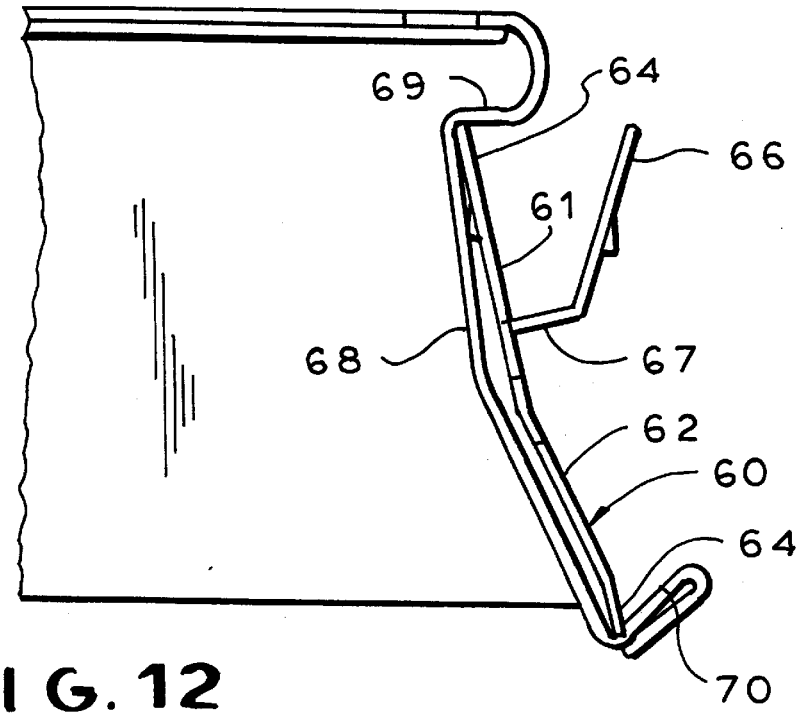
FIGS. 12 and 13 are side elevational views of the mounting clip of FIG. 11, shown in reverse orientations for installation in relatively wider and relatively narrower sizes of pricing channels.
Figure 13:
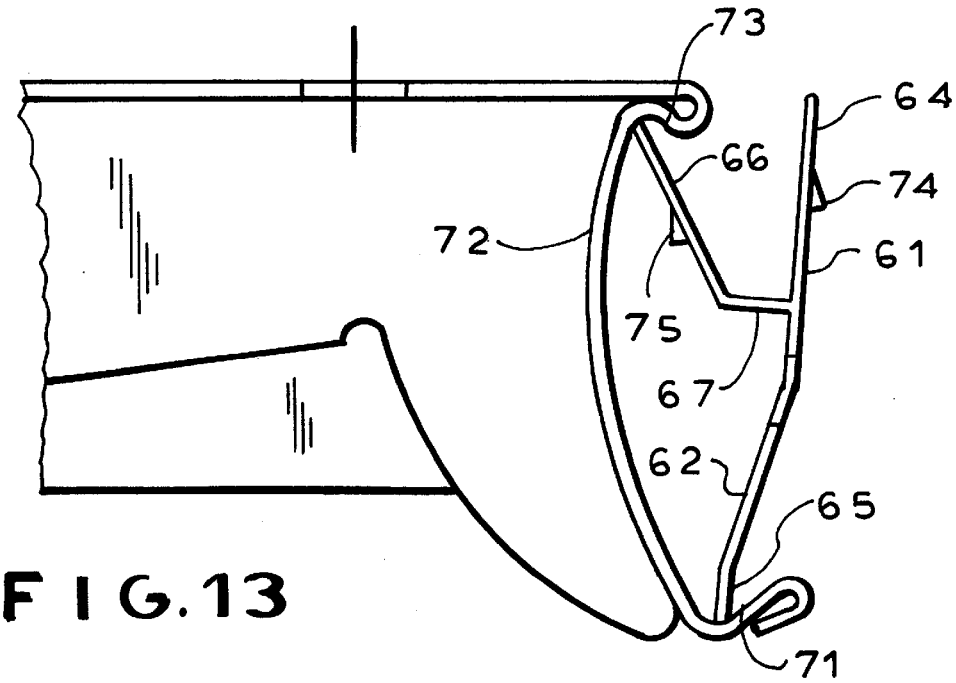

Referring now to FIGS. 11–13 of the drawings, there is shown an alternative preferred form of mounting clip which is designed and constructed to be reversibly positioned within a pricing channel in order to accommodate channels of different height. The reversible clip, generally identified by the reference numeral 60, advantageously is formed of a suitable spring steel material and includes upper and lower body portions 61, 62 joined at a slight angle along an intermediate line 63. The upper body portion has spaced apart, upwardly extending arms 64, and the lower body portion 62 is provided with spaced apart downwardly extending legs 65. Between the upwardly extending arms is an upwardly extending mounting tongue 66 joined integrally with the upper body portion 61 by an offset section 67.

Pursuant to the invention, the configuration of the mounting clip 60 is such that the distance from the upper edges of the mounting tongue 66 to the lower edges of the downwardly extending legs 65 is different than (typically less) the difference between the upper extremities of the arms 64 and the lower extremities of the legs 65.

In a "normal" orientation of the clip 60 of FIGS. 11–13, the clip can be installed in a price channel 68, in the manner shown in FIG. 12, with the arms 64 and legs 65 engaging upper and lower flanges 69, 70 respectively of the price channel. The mounting tongue 66 extends outward and upward in front of the price channel, for mounting of the label holder in a manner previously described.

For a price channel of somewhat narrower dimensions than shown in FIG. 12, for example a channel of the dimensions shown in FIG. 13, the mounting clip can be reversely oriented such that the downwardly extending legs 65 are received at the lower flange 71 of a price channel 72 and the mounting tongue 66 is inserted against the upper flange 73 of the price channel. The two upwardly extending arms 64 are then positioned in a generally vertical orientation in front of the price channel, in the manner shown in FIG. 13. The label holder is then mounted on the upwardly extending arm portions 64 of the mounting clip, which perform the functions of the tongue 66 in the previously described example.

In the mounting clip device of FIGS. 11–13, both the mounting tongue 66 and the upwardly extending arms 64 are provided with punched-out tabs 74, 75, projecting generally downward but in opposite ways for engagement within the downwardly opening slot 38 of the label holder to inhibit removal of the label holder once joined with the mounting clip.

Figure 14:
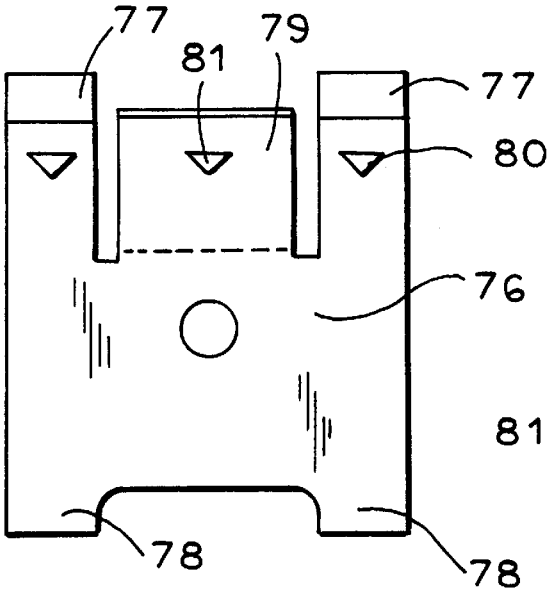
FIGS. 14 and 15 are front and side elevations respectively of a further modified form of mounting clip.
Figure 15:
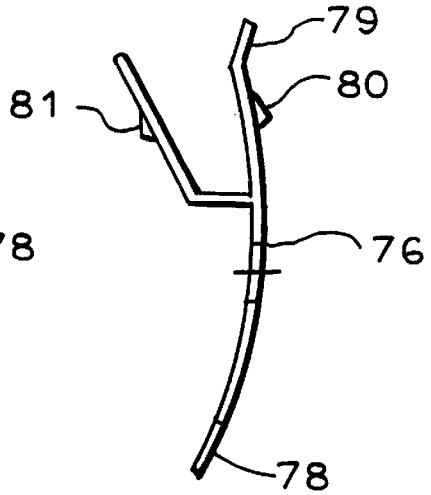

FIGS. 14 and 15 illustrate a modified form of the reversible clip shown in FIGS. 11–13, in which the main body 76 of the clip is of generally arcuate contours, provided with spaced apart upwardly extending arms 77 and downwardly projecting legs 78 as well as an offset, upwardly extending mounting tongue 79. To accommodate reversible application, each of the arms 77 is provided with a punched-out tab 80, and the mounting tongue is provided with a similar tab 81 extending in an opposite direction. The manner of mounting and utilization of the clip of FIGS. 14, 15 is generally the same as that of the clip of FIGS. 11–13.

Figure 16:
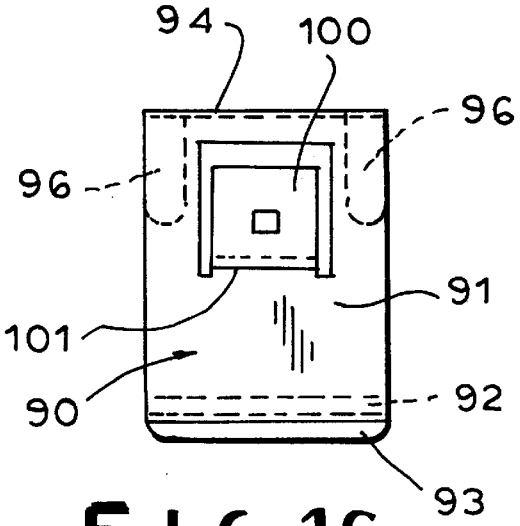
FIG. 16 is a front elevational view of a form of mounting clip useful in connection with metal shelving provided with regularly spaced openings in the surface thereof.

FIGS. 16–18 illustrate an alternative preferred form of mounting clip adapted particularly for shelving of a type containing regularly spaced openings in the display surface of the shelving. The clip 90 (FIG. 16) advantageously may be formed of spring steel strip or other suitable material and includes a body portion 91 which is bent inwardly at the bottom to form a clamping section 92 and guide flange 93. An upper portion 94 of the mounting clip is bent rearwardly from the body 91 to extend in flat relation over the top surface 95 of a display shelf, in the manner illustrated in FIG. 17. At its end, the upper portion 94 is provided with spaced apart, downwardly extending retaining tabs 96 which are arranged to be received in and project through openings 97 in the surface of the shelving. The retaining tabs 96 are spaced apart to correspond with the center-to-center spacing of a pair of openings provided in the shelving, and the width of the tabs is such as to enable them to be freely received in such openings.

In the shelving arrangement of FIG. 17, the clip 90 is mounted by first inserting its tabs 96 through an appropriate pair of openings 97 in the shelving. The inherent resilience and flexibility of the spring material of the clip enables the lower portion to be displaced outwardly of the shelving during this initial step of the installation. Once the tabs are positioned in the proper openings, the lower portion of the clip can be pushed rearwardly until the guide flange 93 clears the lower edge 98 of the pricing channel 99, which locks the mounting clip in position.

The mounting clip 90 includes a stamped-out, forwardly offset and upwardly extending mounting tongue 100, which is integrally attached to the body by a forward offset 101 and is arranged to be received within the downwardly opening slot 38 of a label holder 19, in a manner previously described, such that the label and label holder are securely mounted at the front of the shelving.

In the illustration of FIG. 17, the label housing is more or less vertically oriented. In order to provide upwardly tilted viewing angles, an angle bracket of the type shown in FIGS. 4 and 5 can be employed, in the manner heretofore described.

FIG. 18 illustrates the mounting clip 90 of FIG. 16 installed at the front of a display shelf having a slanted front surface 102, but no price channel of the conventional type. The installation of the clip 90 to such a shelf is similar to that described in connection with FIG. 17, in that the retaining tabs 96 are initially installed in a pair of spaced openings in the shelf upper surface. The selection of openings is such that the front body 91 of the mounting clip is resiliently displaced to a larger than normal angle at the juncture 103 with the upper portion 94. Accordingly, the resilient action of the spring material tends to press the lower clamping portion 92 of the clip inwardly against the front lower corner 104 of the shelving to retain the clip securely in position. The mounting of the label and label holder on the clip is as previously described.

Figure 19:
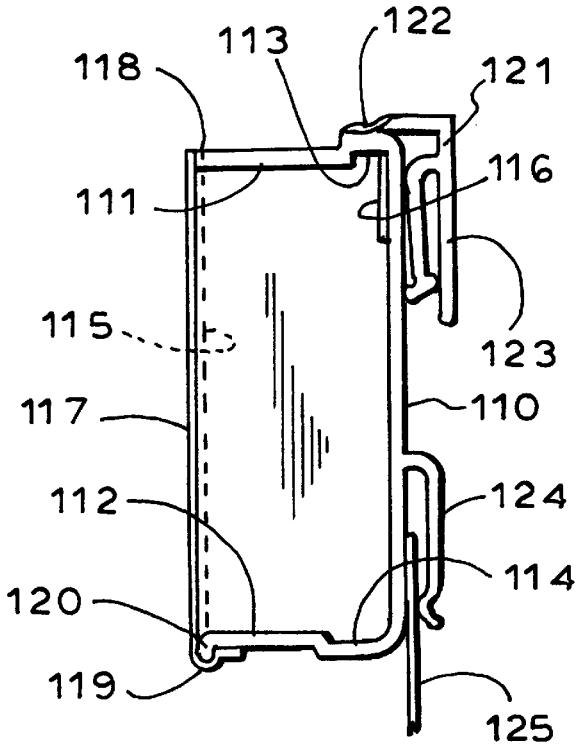
FIG. 19 is a side elevational view of a modified form of plastic housing for receiving and mounting of a second form of electronic label device.

FIG. 19 illustrates a modified form of label holder which comprises an extruded section of uniform cross section comprising a back wall 110 and upper and lower outwardly extending flange walls 111, 112. Both of the flange walls have recesses 113, 114 adjacent the back wall 110, for the reception of edge flanges of an electronic label enclosure, shown in broken lines at 115. The holder of FIG. 19 includes a coextruded pad 116 of soft plastic material projecting slightly forward from the surface of the back wall 110, adjacent at least one of the recesses 113, 114. When an electronic label unit is pressed into the holder, the flange walls 111, 112 are displaced sufficiently to allow the edge flanges of the label to be received in the recesses 113, 114, and the soft pad 116 serves to press outward on the label enclosure to retain it tightly in position.

At the front of the label holder, a clear cover 117 is provided, which is co-extruded with the remainder of the holder, being attached thereto by a co-extruded living hinge portion 118 extending along the upper flange wall 111. At its lower end, the cover is provided with a locking section 119 that can be snapped over a bead flange 120 at the front of the lower flange wall 112 to retain the cover in a normally closed position. Advantageously, a small clearance space is provided between the cover 117 and the front 115 of the electronic label to provide a measure of protection against bumping of the cover.

Figure 4:
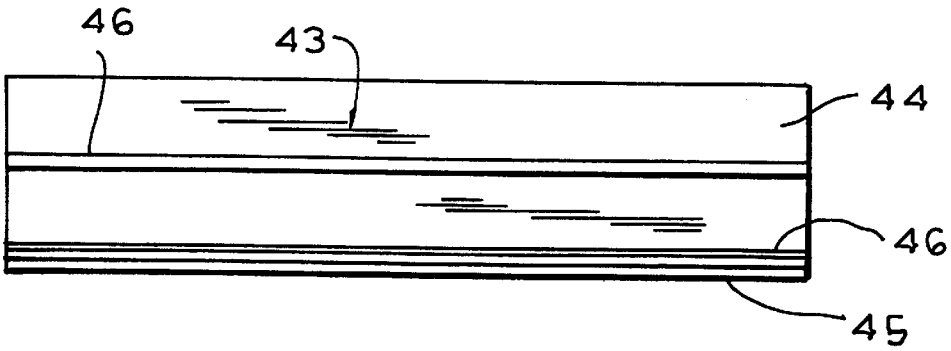
FIGS. 4 and 5 are front and side elevational views respectively of an angle bracket, employed in the arrangements of FIGS. 2 and 3 for supporting the housing and label at a desired viewing angle.
Figure 5:
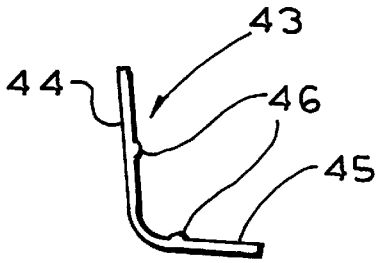

As in the case of the label holder shown in FIGS. 1–3, the label holder of FIG. 19 incorporates a mounting strip 121 which is co-extruded with the label holder and is flexibly attached thereto by a co-extruded living hinge portion 122. As will be understood, the label holder of FIG. 19, is advantageously mounted to the front of a display shelf by means of a mounting clip device such as described herein, with provision for setting desired viewing angles by installation of an angle bracket as shown in FIGS. 4 and 5 herein.

Although it is not a preferred method of mounting the label holder, the mounting strip 121 can be configured to provide a flat back surface 123 which, in a particular case, can be adhesively secured to the front of a display shelf.

The label holder of FIG. 19 desirably incorporates an integrally extruded resilient clip 124 along the lower portion of the back wall. Among other things, the clip 124 enables a special temporary sign or the like 125 to be attached to the electronic label to call special attention thereto, for example.

In any of its various forms, the devices of the invention provide for significantly improved and economical mounting and display of electronic labels. The devices of the invention take into consideration the relatively high cost of such labels and their somewhat delicate nature, in providing for secure but resilient mounting of the electronic label in a manner to inhibit unauthorized movement or removal and to provide a reasonable measure of protection against accidental shocks and bumps from grocery carts or the like.

A particularly advantageous feature of the label holder is the provision of a simple, integrally, flexibly attached mounting strip, which not only provides for the expedient mounting of the label holder at the front of display shelving, but also provides for the reception of a resilient angle bracket by which the viewing angle of the electronic label may be optimally established.

The device of the invention can be associated with a variety of simple, effective mounting clips, which enable the label holder to be easily and securely mounted to existing pricing channels, where such exist, or to the front of metal shelving provided with regularly spaced openings along the top surface of the shelf. The mounting clip shown in FIGS. 7–10 is of an advantageous two-part construction wherein the mating parts are relatively laterally adjustable along the line of mating inclined surfaces. This provides for a wide adjustment of the vertical dimension of the mounting clip, to accommodate a wide variety of pricing channels. In the forms of mounting clips shown in FIGS. 11–15, one-piece mounting clips, formed of spring steel or the like are configured and dimensioned for reversible orientation such that, in one orientation the clip fits effectively in pricing channels of a first range of sizes, and in a second orientation the clip fits in pricing channels of a second range of sizes. Yet a third form of the clip attaches to openings in the top surface of perforated metal shelving.

In any of the forms of mounting clips disclosed herein, a forwardly displaced, upwardly extending mounting tongue is positioned to receive and retain a portion of the mounting strip flexibly attached to the label holder. In the case of the reversibly orientable, one-piece mounting clips of FIGS. 11–15, upwardly extending arms of the clip serve in the functional capacity of an upwardly extending mounting tongue when the clip is "reversely" oriented.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A device for mounting and displaying an electronic label at the front of a product display shelf which comprises, (a) a label holder formed of plastic material and shaped and sized to receive and display the electronic label, (b) a mounting strip permanently flexibly attached to an upper portion of said label holder to form a hinged connection therewith and having a back portion disposed rearwardly of a back wall of said label holder, (c) said back portion being provided with a downwardly opening slot, (d) a mounting element adapted to be fixed to the front of the product display shelf and having an upwardly extending mounting tongue received in said downwardly opening slot and supporting said label holder in front of the product display shelf, (e) said label holder having a predetermined length, (f) said mounting strip extending for a length equal to the length of said label holder, (g) the mounting tongue of said mounting element having a width, in the direction of the length of said mounting strip, substantially less than the length of said mounting strip, received in a fractional length portion of said mounting strip, (h) an angle bracket having first and second portions is mounted with one of said first or second portions inserted in the downwardly opening slot of said mounting strip and the other of said first or second portions extending forwardly into contact with a back wall portion of said label holder to support said label holder in position to hold the electronic label at a predetermined viewing angle.

2. A device according to claim 1, wherein (a) the first and second portions of said angle bracket are of different length, and (b) said first and second portions are alternatively insertable into said downwardly opening slot to support said label holder alternatively at different viewing angles.

3. A device according to claim 1, wherein (a) said angle bracket is formed of resilient plastic material to accommodate limited pivoting motion of said label holder in response to external force.

4. A device for mounting and displaying an electronic label at the front of a product display shelf which comprises, (a) a label holder formed of plastic material and shaped and sized to receive and display the electronic label, (b) a mounting strip permanently flexibly attached to an upper portion of said label holder to form a hinged connection therewith and having a portion disposed rearwardly of a back wall of said label holder, (c) said portion being provided with a downwardly opening slot, and (d) a mounting element adapted to be fixed to the front of the product display shelf and having an upwardly extending mounting tongue received in said downwardly opening slot and supporting said label holder in front of the product display shelf, (e) said mounting element being adapted for reception in a pricing channel mounted on the product display shelf, (f) said mounting element comprises a one-piece section of spring metal material formed with a body portion, upwardly extending portions, downwardly extending portions and said mounting tongue extending outwardly and upwardly from said body portion, (g) said upwardly and downwardly extending portions and said mounting tongue having end extremities, (h) the distance between the end extremities of said downwardly extending portions and of said mounting tongue is different than the distance between the end extremities of said downwardly extending portions and said upwardly extending portions, (i) said mounting element being adapted for installation in the pricing channel alternatively in one orientation, in which the mounting element engages the pricing channel by said upwardly and downwardly extending portions, and a second orientation, in which the mounting element engages the pricing channel by said mounting tongue and said downwardly extending portions.

5. A device according to claim 4, wherein (a) said upwardly extending portions and said mounting tongue are arranged for alternative reception in said downwardly opening slot and are formed with staked-out, downwardly extending tabs for inhibiting removal from said downwardly opening slot.

* * * * *